US007617885B2

(12) United States Patent
Howland

(10) Patent No.: US 7,617,885 B2
(45) Date of Patent: Nov. 17, 2009

(54) DRILL ATTACHMENT

(75) Inventor: Shannon L. Howland, Hamburg, IL (US)

(73) Assignee: Backsaver 2005, LLC, Granite City, IL (US)

( * ) Notice: Subject to any disclaimer, the term of this patent is extended or adjusted under 35 U.S.C. 154(b) by 108 days.

(21) Appl. No.: 11/679,954

(22) Filed: Feb. 28, 2007

(65) Prior Publication Data

US 2008/0202264 A1 Aug. 28, 2008

(51) Int. Cl.
*B25C 1/00* (2006.01)

(52) U.S. Cl. ..... 173/171; 173/170; 173/1; 173/31; 173/36; 227/156

(58) Field of Classification Search ..... 173/1, 173/170, 171, 31, 36; 227/156; 30/296.1, 30/500; 408/712, 99, 110, 112, 136; 16/114.1, 16/421, 430, 901, 426–428; 81/487
See application file for complete search history.

(56) References Cited

U.S. PATENT DOCUMENTS

| | | | | | |
|---|---|---|---|---|---|
| 2,405,110 | A * | 8/1946 | Bullock | 173/141 |
| 3,359,032 | A | 12/1967 | Kochanowski | |
| 3,949,817 | A * | 4/1976 | Rice | 173/170 |
| 3,985,188 | A * | 10/1976 | Steele | 173/170 |
| 4,153,193 | A * | 5/1979 | Urbanowicz | 227/156 |
| 4,339,065 | A * | 7/1982 | Haytayan | 227/8 |
| 4,359,822 | A * | 11/1982 | Kolodziejczyk | 30/296.1 |
| 4,479,599 | A * | 10/1984 | Conrad | 227/9 |
| 5,129,467 | A | 7/1992 | Watanabe et al. | |
| 5,199,625 | A * | 4/1993 | Dewey et al. | 227/8 |
| 5,598,892 | A | 2/1997 | Fox | |
| 7,144,206 | B2 | 12/2006 | Burger et al. | |
| D538,126 | S | 3/2007 | Aglassinger | |
| 7,204,321 | B2 | 4/2007 | Agehara et al. | |
| 7,228,917 | B2 * | 6/2007 | Davis et al. | 173/170 |
| 7,237,707 | B1 * | 7/2007 | Wakelin et al. | 227/147 |
| 7,258,261 | B1 * | 8/2007 | Reyes | 227/110 |

OTHER PUBLICATIONS

International Search Report and Written Opinion for PCT/US2008/054404 dated Jul. 11, 2008 (9 pages).

* cited by examiner

*Primary Examiner*—Rinaldi I. Rada
*Assistant Examiner*—Michelle Lopez
(74) *Attorney, Agent, or Firm*—Ari M. Bai; Poisinelli Shughart PC

(57) ABSTRACT

A drill attachment for engagement and actuation of a drill apparatus having a bifurcated frame defining a first shaft and a second shaft operatively engaged to the drill apparatus at first and second engagement points is disclosed. A handle is pivotally engaged to the first shaft and is operatively coupled to a trigger actuator located along the first shaft through a trigger cable operatively engaged to a trigger actuator the distal end of the first shaft that permits remote actuation of the drill apparatus. The trigger actuator includes a pivotable rocking arm having an actuator pad in selective engagement with the drill trigger such that actuation of the handle by the user pivots the rocking arm in a manner that causes the actuator pad to engage or disengage the drill trigger when operating the drill apparatus. A knee pad may extend from the first shaft to provide the user a contact surface for applying pressure in a lateral direction in order to abut the drill apparatus to the drill surface.

22 Claims, 5 Drawing Sheets

DRILL ATTACHMENT

FIELD

This document relates to a drill attachment, and more particularly to a drill attachment adapted for operative engagement with a drill apparatus.

BACKGROUND

Drill apparatuses, such as hammer drills, are commonly used to drill holes in concrete and other materials during construction activity. In one particular use, a hammer drill may be used to drill holes along an end of a concrete slab by laying the hammer drill on the floor adjacent the concrete slab, abutting the hammer drill to the concrete slab, and drilling a sequence of holes along the end of the concrete slab while maintaining an abutting relationship between the concrete slab and the hammer drill. However, the process of drilling holes with a hammer drill in this manner can be physically exhausting and uncomfortable since the user must sit or kneel down for long periods of time while handling the hammer drill in a manner that ensures that the hammer drill is maintained in the proper orientation during operation. Accordingly, a drill attachment is needed that actuates a hammer drill or like apparatus without requiring the user to directly operate the hammer drill.

SUMMARY

In an embodiment, the drill attachment may comprise a bifurcated frame defining a first shaft and a second shaft, the first shaft defining a proximal shaft portion and distal shaft portion, a handle pivotally engaged to the proximal shaft portion of the first shaft, the handle being operatively engaged with a trigger cable; and a trigger actuator operatively engaged to the trigger cable at the distal portion of the first shaft, the trigger actuator having a rocking arm adapted to pivot relative to the first shaft when actuated by the handle through the trigger cable.

In another embodiment, a drill attachment for actuating a drill apparatus having a drill trigger for operation of the drill apparatus and a drill body defining a first engagement point and a second engagement point, the drill attachment may comprise a bifurcated frame defining a first shaft and a second shaft, the first shaft defining a proximal shaft portion and a distal shaft portion and the second shaft defining a distal shaft portion, a handle pivotally engaged to the proximal shaft portion, the handle being operatively engaged to a trigger cable; and a trigger actuator operatively engaged to the trigger cable at the distal shaft portion, wherein the distal shaft portion is engaged to the first engagement point and the distal shaft portion of the second shaft is engaged to the second engagement point such that the trigger actuator is adapted to engage or disengage the drill trigger when actuated by the handle through the trigger cable.

In yet another embodiment, a method of remotely operating a drill apparatus may comprise providing a drill apparatus having a drill trigger and a body defining a first engagement point and a second engagement point; providing a drill attachment having a bifurcated frame defining a first shaft and a second shaft, the first shaft defining a proximal shaft portion and distal shaft portion, a handle pivotally engaged to the proximal shaft portion of the first shaft, the handle being operatively engaged with a trigger cable, and a trigger actuator operatively engaged to the trigger cable at the distal portion of the first shaft, the trigger actuator having a rocking arm adapted to pivot relative to the first shaft when actuated by the handle through the trigger cable; and engaging the distal shaft portion of the first shaft to the first engagement point and engaging the distal shaft portion of the second shaft to the second engagement point such that the trigger actuator is in operative association with the drill trigger.

Additional objectives, advantages and novel features will be set forth in the description which follows or will become apparent to those skilled in the art upon examination of the drawings and detailed description which follows.

BRIEF DESCRIPTION OF THE DRAWINGS

Corresponding reference characters indicate corresponding elements among the view of the drawings. The headings used in the figures should not be interpreted to limit the scope of the claims.

DETAILED DESCRIPTION

Figure 1:
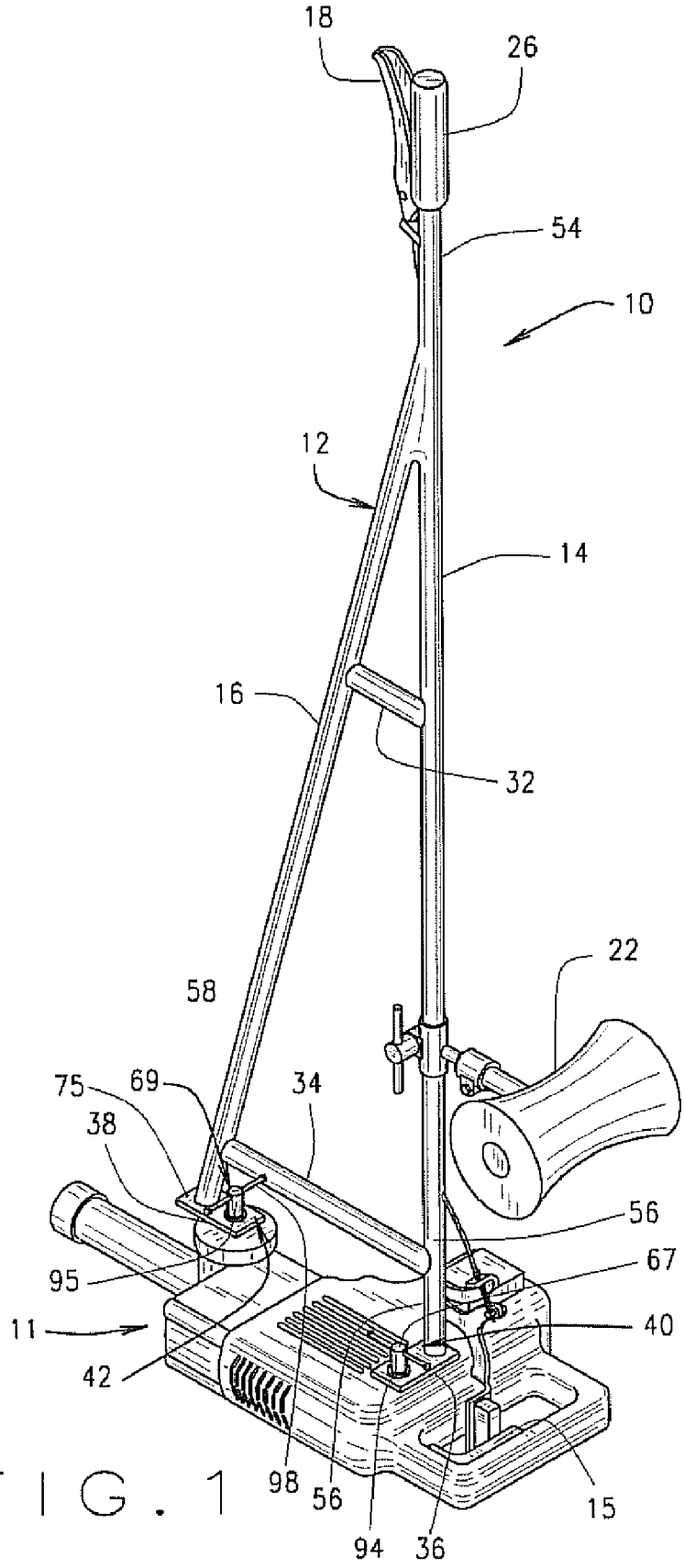
FIG. 1 is a perspective view of a drill attachment operatively engaged to a drill apparatus.
Figure 2:
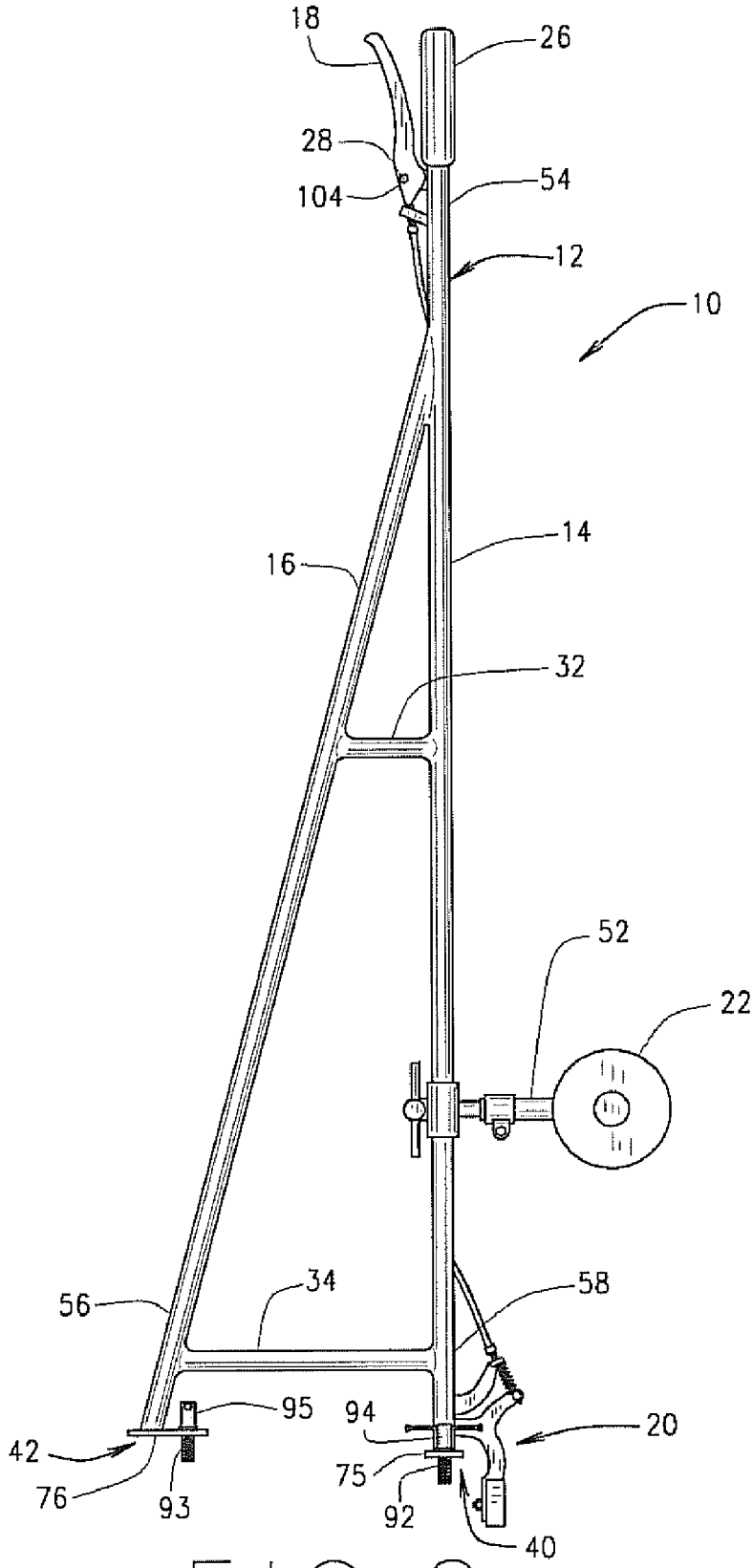
FIG. 2 is a side view of the drill attachment.

Referring to the drawings, an embodiment of the drill attachment is illustrated and generally indicated as 10 in FIG. 1. As shown in FIG. 1, the drill attachment 10 may be adapted to be operatively engaged to a drill apparatus 11 having a drill trigger 15 that may be actuated by the drill attachment 10 such that the user does not have to directly actuate the drill trigger 15 in order to operate the drill apparatus 11. In one embodiment, the drill apparatus 11 may be any type of conventional drill apparatus 11, such as a hammer drill, that has a body 13 defining a first engagement point 36 and a second engagement point 38 for operatively engaging the drill attachment 10 to the drill apparatus 11 at two engagement separate points. For example, the first and second engagement points 36, 38 each define a threaded hole adapted for use in engaging a lateral handle (not shown) along either the first or second engagement points 36, 38 but may also be adapted for use in operatively engaging the drill attachment 10 to the drill apparatus 11.

Referring to FIGS. 2-8, the drill attachment 10 may include a bifurcated frame 12 having an elongated and hollow tubular first shaft 14 defining a proximal shaft portion 54 adapted for handling and actuating of the drill attachment 10 and a distal shaft portion 56 adapted to engage the first engagement point 36 and physically actuate the drill apparatus 11 by the drill attachment 10. In an embodiment, the proximal shaft portion 54 of the first shaft 14 may include a grip 26 made of plastic or rubber material adapted for handling by the user when operating the drill attachment 10.

As shown, the first shaft 14 communicates with an elongated second shaft 16 that extends from the proximal shaft portion 54 at a set angle relative to the first shaft 14. In addition, the second shaft 16 may define a distal shaft portion 58 adapted to engage and secure the drill attachment 10 to the second engagement point 38. In addition, an upper support shaft 32 and a lower support shaft 34 may be laterally interposed between the first shaft 14 and second shaft 16 to provide structural support and reinforcement for the bifurcated frame 12. As noted above, the first shaft 14 and second shaft 16 may be adapted to engage the drill apparatus 11 at the first and second engagement points 36, 38, respectively, in order to operatively engage the drill attachment 10 to the drill apparatus 11 such that the drill trigger 15 is actuated when the drill attachment is operated.

Figure 3:
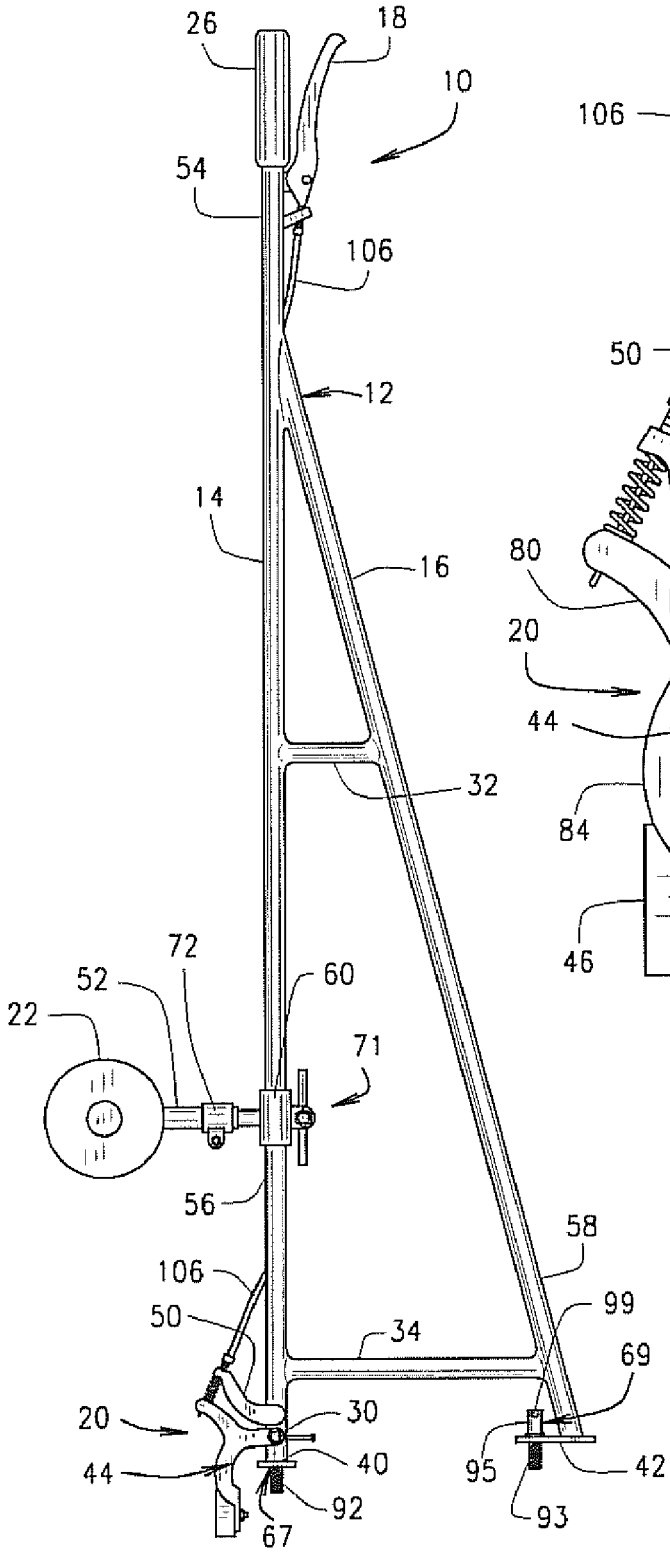
FIG. 3 is an opposing side view of the drill attachment
Figure 3A:
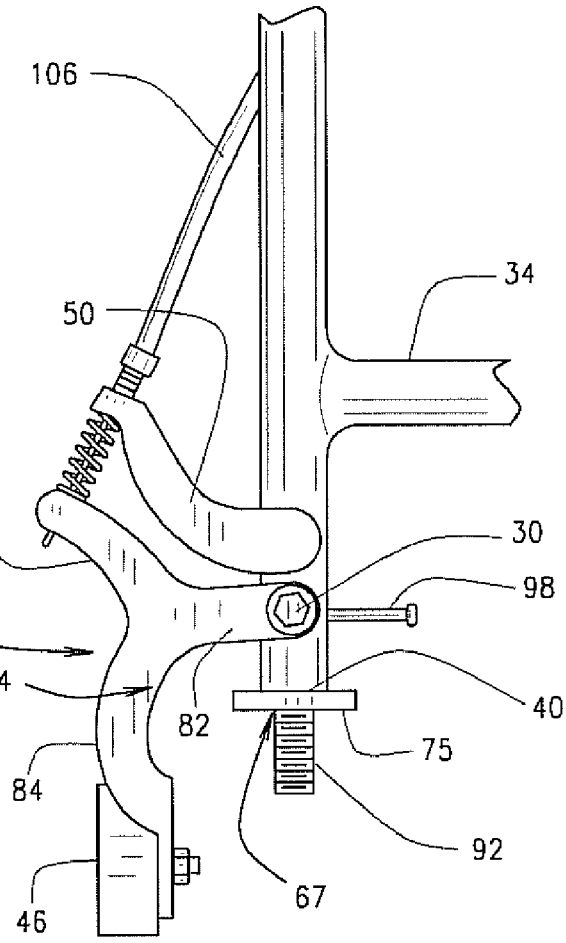
Figure 7:
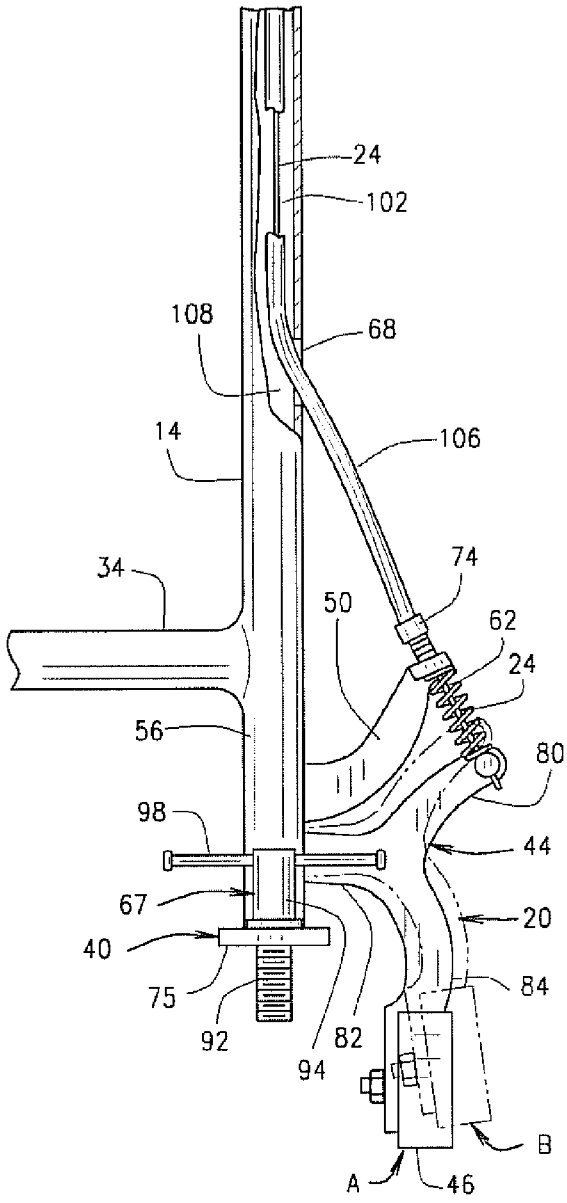
FIG. 7 is a partial cross sectional view of the drill attachment showing the actuation of a trigger actuator by the handle.

Referring to FIGS. 3A and 7, first shaft 14 may include a first base plate 40 adapted to engage the first engagement point 36 of the drill apparatus 11. In particular, the first base plate 40 may define a planar surface 75 adapted to contact the body 13 of the drill apparatus 11 and a fastening mechanism 67 adapted to engage internal threads (not shown) defined by the first engagement point 36 when engaging the first shaft 14 to the drill apparatus 11. The fastening mechanism 67 may further include a slidable rod 98 operatively engaged to a rotating member 94 having external threads 92 adapted to engage the internal threads of the first engagement point 36. In operation, the user engages the external threads 92 with the internal threads of the first engagement point 36 and then rotates the rod 98 such that the rotating member 94 becomes engaged with the first engagement point 36. Conversely, rotation of the rod 98 in an opposite direction will disengage the rotating member 94 from the first engagement point 36.

As shown in FIG. 3, second shaft 16 may include a second base plate 42 adapted to engage the second shaft 16 of the bifurcated frame 12 to the second engagement point 38 defined by the drill apparatus 11. The second base plate 42 may include a fastening mechanism 69 adapted to engage internal threads (not shown) defined by the second engagement point 36. The fastening mechanism 69 may include a rotating member 95 operatively associated with a slidable rod 99. The rotating member 95 further includes external threads 93 adapted to engage the internal threads of the second engagement point 38 in the same manner as fastening mechanism 67 such that rotation of the rod 99 either engages or disengages the rotating member 95 relative to the second engagement point 38. The bifurcated frame 12 is engaged to the first and second engagement points 36, 38 in a manner that permits the operation of the drill apparatus 11 by actuation of the drill attachment 10 as shall be discussed in greater detail below.

Figure 6:
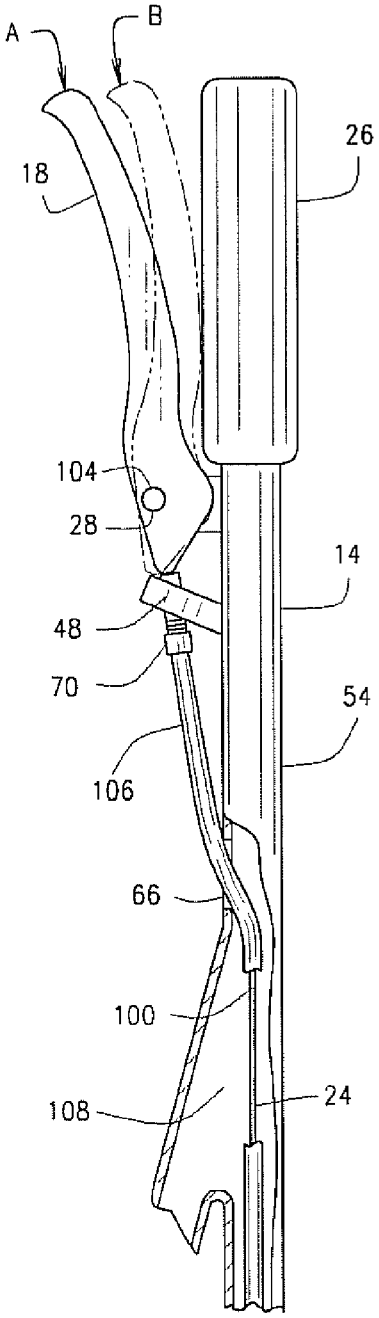
FIG. 6 is a partial cross sectional view of the drill attachment showing the actuation of a handle.

Referring to FIGS. 1 and 6, a handle 18 may be secured to the proximal shaft portion 54 of first shaft 14 to provide a means of actuating the drill apparatus 11 using the pivot action of the handle 18 to actuate the drill trigger 15. The handle 18 is pivotally engaged along the proximal shaft portion 54 of the first shaft 14 at a first pivot point 28. A screw 104 engages the handle 18 at first pivot point 28 such that the handle 18 may be pivoted between a position A wherein the handle 18 is unbiased and does not actuate the drill trigger 15 and a position B (shown in phantom) wherein the user pulls the handle 18 back toward the grip 26 to actuate the drill trigger 15 and then allowing the handle 18 to be biased back to a resting position A in order to terminate operation of the drill apparatus 11.

Referring to FIGS. 6 and 7, the handle 18 is operatively engaged to a trigger actuator 20 through a trigger cable 24 slidably enclosed in a cable sheath 106 that provides a protective covering to the trigger cable 24. In one embodiment, the trigger cable 24 may be made from a metal wire having a proximal portion 100 engaged to the handle 18 and a distal portion 102 operatively engaged to the trigger actuator 20 such that the action of the trigger cable 24 actuates or terminates actuation of the drill trigger 15. A stationary arm 48 may extend from the first shaft 14 and engages the trigger cable 24 proximate the handle 18.

In one embodiment, the cable sheath 106 may be disposed within the hollow construction of the bifurcated frame 12. The cable sheath 106 may enter a first opening 66 defined along the proximal shaft portion 56 of first shaft 14. The first opening 66 (FIG. 6) communicates with a second opening 68 (FIG. 7) defined at the distal shaft portion 54 through a conduit 108 formed along the first shaft 14. As such, a substantial portion of the cable sheath 106 may be disposed inside the bifurcated frame 12. In the alternative, a metal rod (not shown) may be substituted for the trigger cable 24 which may be operatively engaged between the handle 18 and the trigger actuator 20 that is disposed outside the bifurcated frame 12 in order to provide a means for actuating the trigger actuator 20 upon operation of the handle 18.

The trigger actuator 20 may include a stationary arm 50 secured to the distal shaft portion 54 of the first shaft 14 which is adapted to engage the distal portion 102 of trigger cable 24. The trigger actuator 20 may further include a rocking arm 44 that pivots about a second pivot point 30 (FIG. 3) defined along the proximal shaft portion 54 of the first shaft 14 between positions A and B. In this embodiment, position A depicts the trigger actuator 20 in the disengaged position relative to drill trigger 15, while position B depicts the trigger actuator 20 in the engaged position relative to drill trigger 15. The rocking arm 44 of the drill trigger 20 permits selective operation of the drill apparatus 11 when pivoted by operation of the handle 18 such that the drill trigger 20 is either engaged (position B) or disengaged (position A).

Figure 4:
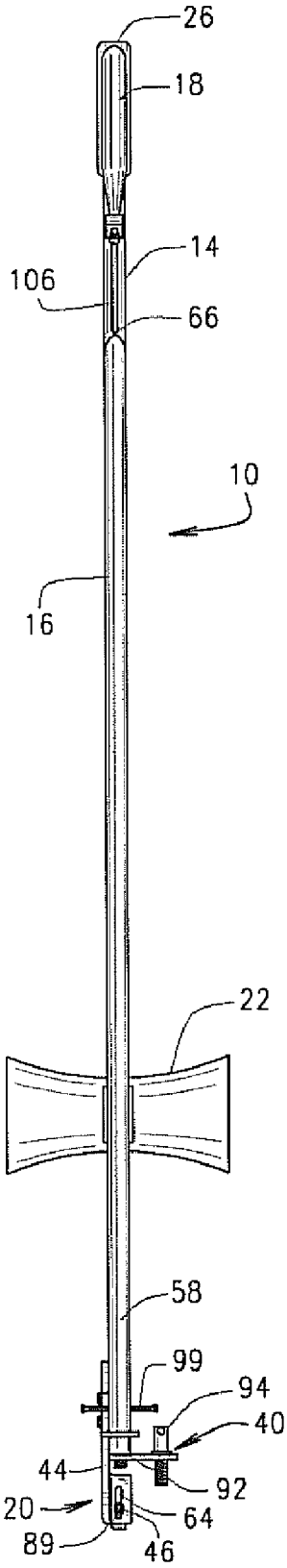
FIG. 4 is a rear view of the drill attachment.
Figure 5:
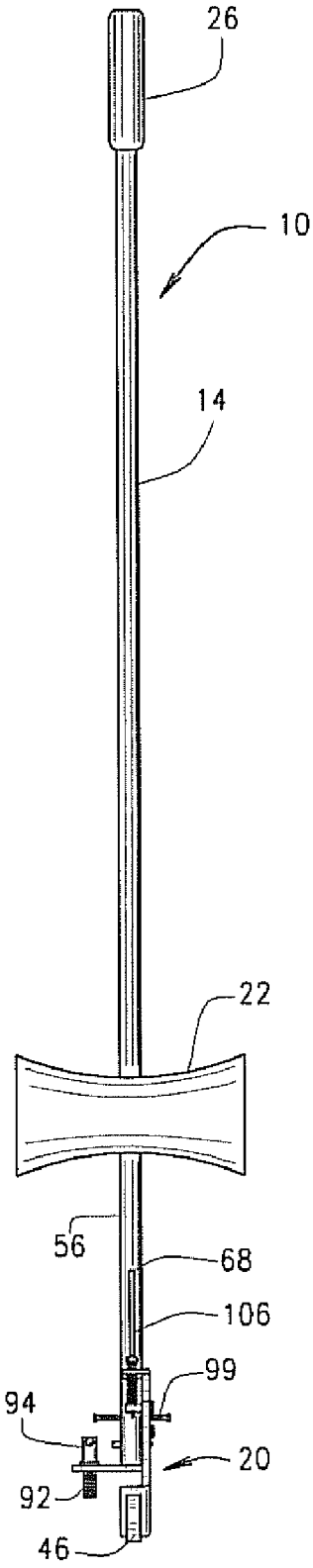
FIG. 5 is a front view of the drill attachment.

As shown, the rocking arm 44 defines a retaining arm 80 that is operatively engaged to the terminal end of the trigger cable 24, a pivoting arm 82 that pivots about second pivot point 30 when actuated by the handle 18, and an actuating arm 84 defining a slot 64 having an actuating pad 46 that is adapted to engage or disengage the drill trigger 15 when the rocking arm 44 is pivoted by the action of the trigger cable 24. Referring to FIG. 4, in one embodiment a bolt and nut arrangement 89 may be used to secure and adjust the actuating pad 46 along the slot 64.

In addition, a tightening nut 74 may be operatively engaged to the trigger cable 24 proximate the trigger actuator 20 such that rotation of the tightening nut 74 causes the trigger cable 24 to be lengthened or shortened in order to loosen or tighten the trigger cable 24 relative to the trigger actuator 20. Another tightening nut 70 may be operatively engaged to the trigger cable 24 proximate the handle 18 in order to also adjust the length of the trigger cable 24 in a similar manner.

The trigger cable 24 may be operatively engaged between the stationary arm 50 and the retaining arm 80 of the rocking arm 44 such that actuation of the handle 18 allows the trigger cable 24 to lift the retaining arm 80 by the pulling action of the trigger cable 24 which causes the rocking arm 44 to pivot. This pivoting action of the rocking arm 44 around the second pivot point 30 causes the actuation arm 84 to move between position A and position B in order to engage and disengage the drill trigger 15 and operate the drill apparatus 11. A spring 62 may be provided between the stationary arm 50 and the rocking arm 44 for providing a biasing action such that release of the handle 18 causes the rocking arm 44 to be biased back to position A which disengages the actuating pad 46 from the drill trigger 15 and terminates operation of drill apparatus 11. In one embodiment, the trigger cable 24 may be disposed within the coiled lumen of the spring 62.

Referring to FIG. 3, in an embodiment the drill attachment 10 may further include a knee pad 22 which is engaged to the first shaft 14 through a lateral knee pad arm 52. The knee pad arm 52 may include an adjustable sleeve 60 in operative engagement with a fastening mechanism 71 in order to adjust the height of the knee pad arm 52 relative to first shaft 14. In addition, a secondary adjustable sleeve 72 may be provided along the secondary sleeve 72 for adjusting the distance of the adjustable sleeve 60 relative to the first shaft 14. The knee pad 22 may provide a soft contact surface for use by the operator to engage with the user's knee in order to apply a force against the drill apparatus 11 when abutting the drill apparatus 11 against a concrete slab or other drill apparatus surface.

Once the drill attachment 10 is secured to the drill apparatus 11 in the manner described above, the user may operate the drill attachment 10 by gripping the handle 18 and grip 26 with one hand and the second shaft 16 with the other hand. As noted above, the user may engage the knee pad 22 with the user's knee in order to apply a lateral force to the drill apparatus 11 through the drill attachment 10. The user may then squeeze the handle 11 which pivots the rocking arm 44 from position A to position B and causes the drill trigger 15 to be engaged by the actuation arm 84 until the user releases the handle 18 which is biased back to position A.

In one embodiment, the first shaft 14, second shaft 16, upper support shaft 32 and lower support shaft 34 may be welded together, although other methods of attachment are contemplated, such as using a bolt and screw combination, or other mechanical arrangement to assemble and secure the bifurcated assembly 12.

In another embodiment, the drill attachment 10 may be operatively engaged with a cordless drill or a corded drill. In addition, the drill attachment 10 may be operatively engaged to the aforementioned types of drills in order to auger holes in wood, masonry, or concrete either at grade or overhead levels.

It should be understood from the foregoing that, while particular embodiments have been illustrated and described, various modifications can be made thereto without departing from the spirit and scope of the invention as will be apparent to those skilled in the art. Such changes and modifications are within the scope and teachings of this invention as defined in the claims appended hereto.

What is claimed is:

1. A drill attachment for a drill apparatus comprising:

a bifurcated frame defining a first shaft and a second shaft, the first shaft defining a proximal shaft portion and distal shaft portion, a handle pivotally engaged to the proximal shaft portion of the first shaft, the handle being coupled with a trigger cable; and a trigger actuator coupled to the trigger cable at the distal shaft portion of the first shaft, the trigger actuator having a rocking arm that pivots on the first shaft and is coupled to the trigger cable, and a lateral knee pad arm engaged to said first shaft such that the first shaft of the bifurcated frame is perpendicular to a longitudinal axis of a drill apparatus that is engaged to the drill attachment and the lateral knee pad arm is parallel to the longitudinal axis of the drill apparatus.

2. The drill attachment according to claim 1, wherein said proximal shaft portion of said first shaft includes a grip.

3. The drill attachment according to claim 1, wherein said bifurcated frame has at least one support shaft interposed between said first shaft and said second shaft.

4. The drill attachment according to claim 1, wherein said knee pad arm includes a knee pad.

5. The drill attachment according to claim 1, wherein said lateral knee pad arm is adjustable relative to said first shaft.

6. The drill attachment according to claim 1, wherein said handle pivots about a first pivot point and said rocking arm pivots about a second pivot point defined along said first shaft.

7. The drill attachment according to claim 6, wherein said rocking arm defines a retaining arm, a pivoting arm, and an actuating arm.

8. The drill attachment according to claim 7, wherein said retaining arm is operatively engaged to said trigger cable.

9. The drill attachment according to claim 7, wherein said pivoting arm pivots about said second pivot point.

10. The drill attachment according to claim 7, wherein said actuating arm includes an actuating pad.

11. The drill attachment according to claim 10, wherein said actuating arm defines a slot adapted to receive said actuating pad.

12. The drill attachment according to claim 1, wherein said first shaft defines a first opening in communication with a second opening through a conduit.

13. The drill attachment according to claim 12, wherein said trigger cable is disposed inside said conduit.

14. The drill attachment according to claim 1, wherein said distal shaft portion of said first shaft and said distal shaft portion of said second shaft each include a fastening mechanism.

15. A drill attachment comprising:

a bifurcated frame defining a first shaft and a second shaft, the first shaft defining a proximal shaft portion and distal shaft portion, a handle pivotally engaged to the proximal shaft portion of the first shaft, the handle being coupled with a trigger cable; and a trigger actuator coupled to the trigger cable at the distal shaft portion of the first shaft, the trigger actuator having a rocking arm that pivots on the first shaft and is coupled to the trigger cable, the rocking arm including a retaining arm wherein said trigger actuator further includes a stationary arm secured to said distal shaft portion of said first shaft, said stationary arm being coupled to said trigger cable wherein a spring has one end coupled to said stationary arm and the other end of the spring being coupled to the retaining arm of said rocking arm, said spring applying a biasing force from the spring to said rocking arm.

16. A drill attachment for actuating a drill apparatus having a drill trigger for operation of the drill apparatus and a drill body defining a first engagement point and a second engagement point, the drill attachment comprising a bifurcated frame defining a first shaft and a second shaft, the first shaft defining a proximal shaft portion and a distal shaft portion and the second shaft defining a distal shaft portion, a handle pivotally engaged to the proximal shaft portion, the handle being coupled to a trigger cable; and a trigger actuator coupled to the trigger cable at the distal shaft portion wherein said trigger actuator includes a rocking arm that pivots on said first shaft, said rocking arm being coupled to said trigger cable in order to pivot said rocking arm and actuate the drill apparatus and includes a retaining arm, wherein said trigger actuator further includes a stationary arm secured to said distal shaft portion of said first shaft, said stationary arm being coupled to said trigger cable, wherein a spring has one end coupled to the stationary arm and the other end of the spring being coupled to the retaining arm of said rocking arm, said spring applying a biasing force from the spring to said rocking arm, wherein the distal shaft portion is engaged to the first engagement point and the distal shaft portion of the second shaft is engaged to the second engagement point such that the rocking arm is movable between a first engaged position with the drill trigger to actuate the drill apparatus when actuated by the handle through the trigger cable and a second disengaged position with the drill trigger to terminate operation of the drill apparatus.

17. The drill attachment according to claim 16, wherein said proximal shaft portion of said first shaft includes a grip.

18. The drill attachment according to claim 16, wherein said first engagement point and said second engagement point define a threaded hole, respectively, adapted to engage said first and second shafts, respectively.

19. A method of remotely operating a drill apparatus comprising:

providing a drill apparatus having a drill trigger and a body defining a first engagement point and a second engagement point;

providing a drill attachment having a bifurcated frame defining a first shaft and a second shaft, the first shaft defining a proximal shaft portion and distal shaft portion, a handle pivotally engaged to the proximal shaft portion of the first shaft, the handle being coupled to a trigger cable, and a trigger actuator coupled to the trigger cable at the distal shaft portion of the first shaft, the trigger actuator having a rocking arm that pivots on the first shaft and is coupled to the trigger cable, wherein the rocking arm includes a retaining arm, wherein the trigger actuator further includes a stationary arm secured to the distal shaft portion of said first shaft, the stationary arm being coupled to the trigger cable, wherein a spring has one end coupled to the stationary arm and the other end of the spring being coupled to the retaining arm of the rocking arm, the spring applying a biasing force from the spring to the rocking arm; and engaging the distal shaft portion of the first shaft to the first engagement point and engaging the distal shaft portion of the second shaft to the second engagement point such that the trigger actuator is in operative association with the drill triggers wherein the rocking arm has a first engaged position that engages and actuates the drill trigger and a second disengaged position that disengages the drill trigger and terminates operation of the drill apparatus.

20. The method according to claim 19, wherein actuation of the handle causes said trigger actuator to engage said drill trigger and operate said drill apparatus when said first shaft is engaged to said first engagement point and said second shaft is engaged to said second engagement point.

21. The method according to claim 19, wherein said first shaft includes a knee pad, said method further including engaging said knee pad with a user's knee when actuating said handle.

22. The method according to claim 19, wherein said first shaft and said second shaft include respective fastening mechanisms for engaging said first shaft and said second shaft, respectively, to said first engagement point and said second engagement point, respectively.

* * * * *